United States Patent [19]

Munch

[11] 3,991,657

[45] Nov. 16, 1976

[54] VANED HYDRAULIC MOTOR

[75] Inventor: Heinrich Münch, Hamburg, Germany

[73] Assignee: Licentia Patent-Verwaltungs-G.m.b.H., Frankfurt am Main, Germany

[22] Filed: May 27, 1975

[21] Appl. No.: 580,961

[30] Foreign Application Priority Data

May 27, 1974 Germany ..... 2425496

[52] U.S. Cl. ..... 91/411 A; 92/150; 60/484; 418/210

[51] Int. Cl.[2] ..... F15B 11/16

[58] Field of Search ..... 91/411 A, 411 R, 339; 92/150, 151, 152, 120; 60/484; 418/210, 213

[56] References Cited

UNITED STATES PATENTS

| | | | |
|---|---|---|---|
| 858,778 | 7/1907 | Austin | 418/213 X |
| 3,037,355 | 6/1962 | Braithwaite | 91/411 A X |
| 3,348,624 | 10/1967 | Just et al. | 60/484 X |
| 3,421,389 | 1/1969 | Fauchere | 60/484 X |
| 3,582,245 | 6/1971 | Wallace | 91/411 A |

FOREIGN PATENTS OR APPLICATIONS

| | | | |
|---|---|---|---|
| 418,163 | 9/1925 | Germany | 418/210 |

*Primary Examiner*—Edgar W. Geoghegan
*Attorney, Agent, or Firm*—Spencer & Kaye

[57] ABSTRACT

A vaned hydraulic motor which includes a rotor adapted to rotate in excess of 180° with respect to the stator, has, in an axial juxtaposition, a middle circumference annular chamber and two outer circumferential annular chambers flanking the middle annular chamber. The axial width dimension of each of the outer annular chambers is one half of the axial width dimension of the middle annular chamber. In each annular chamber there are disposed first and second radial partitions forming a separate partition pair for subdividing each annular chamber into two pressure chambers. The first partition of each pair is affixed to the stator and the second partition of each pair is affixed to the rotor. Further, the second partition in the middle annular chamber is offset 180° with respect to the second partition in each outer annular chamber.

4 Claims, 2 Drawing Figures

VANED HYDRAULIC MOTOR

BACKGROUND OF THE INVENTION

This invention relates to a vaned hydraulic motor designed to execute angular motions in excess of 180°.

A vaned hydraulic motor of the above-outlined type is disclosed, for example, in U.S. Pat. No. 2,350,066. In the structure according to this patent, between the stator and the rotor there are provided two annular chambers which are each subdivided by two radial partitions into two pressure chambers. One of the radial partitions in each instance is mounted on the stator while the other (which constitutes a vane) is secured to the rotor. The rotor is capable of rotating through approximately 270° with respect to the stator. The radial hydraulic forces generated in the annular chambers are, however, not in equilibrium so that through the radial bearings there are transmitted substantial forces which generate significant frictional torques that reduce the efficiency of the motor.

SUMMARY OF THE INVENTION

It is an object of the invention to provide an improved vaned hydraulic motor adapted to execute angular displacements in excess of 180°, wherein the radial forces generated in the annular chambers mutually cancel one another and thus do not exert a stress on the radial bearings.

This object and others to become apparent as the specification progresses, are accomplished by the invention, according to which, briefly stated, in the vaned motor there are arranged a middle annular chamber and two flanking outer annular chambers in an axial series. The two outer annular chambers each have in the axial direction, a width dimension which is one-half the axial width of the middle annular chamber. Further, each annular chamber is subdivided into two pressure chambers by two radial partitions. In each instance, one partition is secured to the stator and the other (constituting a vane) is mounted on the rotor. The partitions (vanes) which form part of the flanking, outer annular chambers and which are secured to the rotor are offset 180° with respect to the partition (vane) which forms part of the middle annular chamber and which is secured to the rotor.

In a vaned hydraulic motor of the above-outlined structure, during the transmission of a torque, the radial forces generated in the annular chambers mutually cancel one another so that they do not represent a load for the radial bearings of the hydraulic motor.

DESCRIPTION OF THE PREFERRED EMBODIMENT

Figure 1:
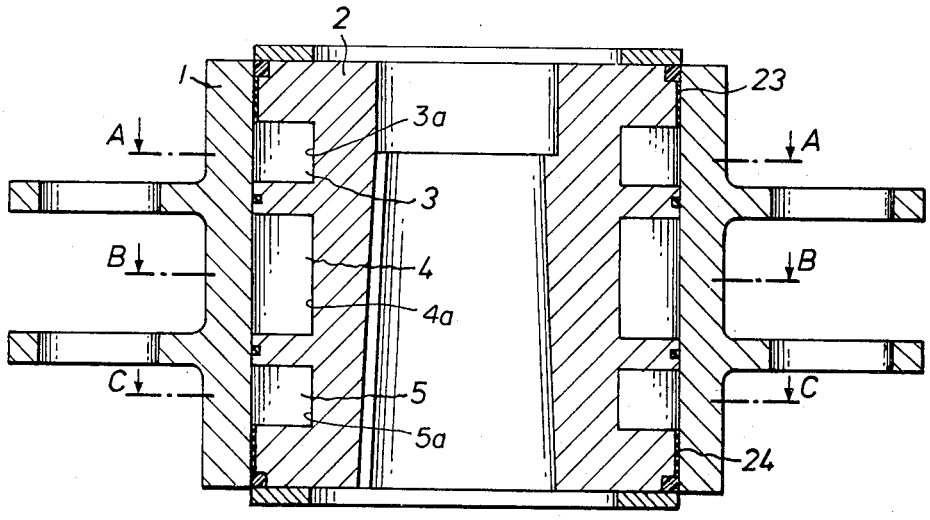
FIG. 1 is an axial sectional view of a preferred embodiment of the invention.

Turning now to the FIG. 1, in the cylindrical bore of a stator 1 there is rotatably supported a cylindrical rotor 2. In the rotor surface there are provided three circumferential annular grooves which are closed off by the inner wall of the stator and which constitute, in axial juxtaposition, a middle annular chamber 4 and two flanking outer annular chambers 3 and 5. The two flanking annular chambers 3 and 5 have, in the axial direction, a dimension which is one-half of that of the middle annular chamber 4. Expediently, the annular chambers 3, 4 and 5 have a rectangular axial cross section and each has a respective floor surface 3*a*, 4*a* and 5*a*.

Figure 2:
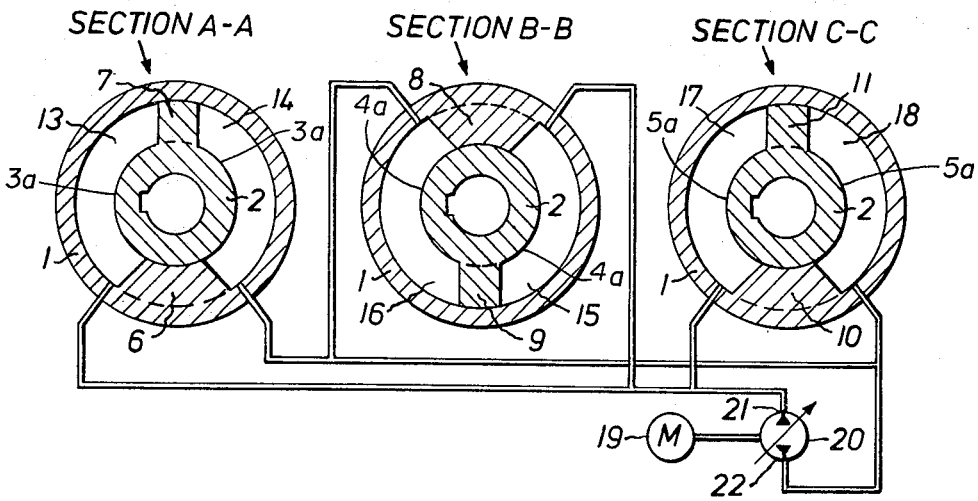
FIG. 2 is a diagrammatic view of the same embodiment, illustrating in juxtaposition, and on a reduced scale, the sections along lines A—A, B—B and C—C of FIG. 1 and further illustrating the hydraulic supply circuit connected to the sections.

From a comparison of FIG. 1 and diagrammatic FIG. 2 it is seen that the annular chamber 3 is subdivided by partitions 6 and 7 into pressure chambers 13 and 14; the annular chamber 4 is subdivided by partitions 8 and 9 into pressure chambers 15 and 16; and the annular chamber 5 is subdivided by partitions 10 and 11 into pressure chambers 17 and 18. The partitions 7, 9 and 11 are attached to the rotor 2 and constitute vanes, while the partitions 6, 8 and 10 form part of the stator 1. Further, the rotor vane 9 associated with the middle annular chamber 4 is offset 180° with respect to the rotor vanes 7 and 11 associated with the flanking annular chambers 3 and 5, respectively. The partitions 6, 8 and 10 extend radially inwardly from the inner stator surface and slidingly engage the floor surfaces 3*a*, 4*a* and 5*a* of the respective annular chambers 3, 4 and 5. The vanes 7, 9 and 11 extend radially outwardly from the respective floor surfaces 3*a*, 4*a* and 5*a* and slidingly engage the inner stator surface.

The pressure chambers 13, 15 and 17 are connected hydraulically parallel to one another and are coupled to the high pressure side 21 of a pump 20 which is driven by a pump motor 19. The pressure chambers 14, 16 and 18 are also connected in parallel and are coupled to the low pressure side 22 of the pump 20.

Upon operation of the pump 20, the pressure difference between the hydraulic medium in the pressure chambers 13, 15 and 17, on the one hand, and in the pressure chambers 14, 16 and 18, on the other hand, generates, at the vanes 7, 9 and 11, circumferential forces all directed clockwise, as viewed in FIG. 2. There is thus generated a torque between the stator 1 and the rotor 2.

By virtue of the above-described dimensioning of the annular chambers 3, 4 and 5 and the 180° offset of the vane 9 with respect to the vanes 7 and 11, the resultant of the radial forces generated in the pressure chambers 13–18 is always zero and thus the radial bearings 23 and 24 inserted between the stator 1 and the rotor 2 will not be exposed to radial forces.

It will be understood that the above description of the present invention is susceptible to various modifications, changes and adaptations, and the same are intended to be comprehended within the meaning and range of equivalents of the appended claims.

What is claimed is:

1. A vaned hydraulic motor having a stator provided with an inner surface, a rotor supported within the stator and having an angle of possible rotation in excess of 180° with respect to the stator, comprising a. means defining in said rotor a middle circumferential annular chamber and two outer circumferential annular chambers flanking the middle annular chamber, said annular chambers being disposed in axial juxtaposition and each having a floor surface; the axial width dimension of each of the outer annular chambers being one half of the axial width dimension of the middle annular chamber; and b. first and second radial partitions forming a separate partition pair in each said annular chamber for subdividing each said annular chamber into two pressure chambers; said first partition of each pair being affixed to said stator and extending radially inwardly from the inner stator surface and being in sliding contact with the floor surface of the respective annular chamber; said second partition of each pair being affixed to said rotor and extending radially outwardly from the floor surface of the respective annular chamber and being in sliding contact with the inner stator surface; the second partition in said middle annular chamber being offset 180° with respect to the second partitions in said outer annular chambers, respectively.

2. A vaned hydraulic motor as defined in claim 1, wherein the inner surface of said stator is cylindrical and the rotor has an outer cylindrical surface; said means defining each said circumferential annular chamber including a circumferential annular groove provided in the outer cylindrical surface of said rotor and a portion of the inner cylindrical surface of said stator covering the circumferential annular groove.

3. A vaned hydraulic motor as defined in claim 1, wherein said circumferential annular chambers have a rectangular axial cross section.

4. A vaned hydraulic motor as defined in claim 1, further including a hydraulic circuit including a pump having a high pressure side and a low pressure side; first conduit means connecting one pressure chamber of each annular chamber to the high pressure side of said pump and parallel to one another; and second conduit means connecting the other pressure chamber of each annular chamber to the low pressure side of said pump and parallel to one another; the differential pressure in each annular chamber exerting a torque on said rotor through said second partitions.

* * * * *